United States Patent [19]

Slota et al.

[11] Patent Number: 4,770,322

[45] Date of Patent: Sep. 13, 1988

[54] ROLL STAMP DISPENSER

[76] Inventors: William P. Slota, 17241 Septo St., Northridge, Calif. 91325; Terrance Chin, 18234 Shepley Pl., Northridge, Calif. 91326

[21] Appl. No.: 108,244

[22] Filed: Mar. 17, 1987

Related U.S. Application Data

[63] Continuation of Ser. No. 512,389, Jul. 11, 1983, abandoned.

[51] Int. Cl.[4] ..... B65H 20/22

[52] U.S. Cl. ..... 221/240; 225/16; 226/68; 206/39.4

[58] Field of Search ..... 221/24, 26, 240; 226/68; 83/278, 423; 225/10–11, 16, 52; 206/39, 39.4, 39.8

[56] References Cited

U.S. PATENT DOCUMENTS

| | | | |
|---|---|---|---|
| 909,861 | 1/1909 | Barry | 225/16 |
| 1,216,799 | 2/1917 | Hall | 83/278 X |
| 1,339,823 | 5/1920 | Harbaugh | 225/52 X |
| 2,930,610 | 3/1960 | Swartz | 226/68 |
| 4,202,468 | 5/1980 | Anderson et al. | 226/68 X |

FOREIGN PATENT DOCUMENTS

| | | | |
|---|---|---|---|
| 537459 | 11/1931 | Fed. Rep. of Germany | 226/68 |

*Primary Examiner*—Charles A. Marmor
*Attorney, Agent, or Firm*—Don B. Finkelstein

[57] ABSTRACT

A stamp dispensing arrangement for dispensing stamps, such as postage stamps, one at a time from a roll of such stamps. The dispensing arrangement has a unitary body comprised of a base and a cover hingedly interconnected for relative pivotal movement therebetween from a closed to an open position. A roll of stamps is contained within a cavity defined in a stamp storage portion of the body and the stamps extend outwardly between spaced apart planer surfaces of the cover and the base at a dispensing end. First fingers with stamp engaging tabs thereon are positioned in an aperture in the planer wall of the base and are adapted to engage the stamps in the perforations thereof to prevent movement of the stamps in a first direction which is opposite to the second or dispensing direction. A manually operable slide is mounted for reciprocal motion in the first and second directions in an aperture in the planer wall of the cover and has second stamp engaging fingers with tabs thereon for engaging the stamps in the perforations thereof and moving the stamps the preselected distance corresponding to approximately the distance between rows of perforations until a full stamp projects from the dispensing end edge of the dispensing end of the body where such individual stamp may be manually served. The slide is then returned to its original position by movement in the first direction and the tabs on the second finger means slide over the surface of the stamps as the slide is moved in the first direction, the tabs on the first finger means preventing movement of the roll of stamps during such movement in the first direction by the slide.

10 Claims, 2 Drawing Sheets

FIG. 1
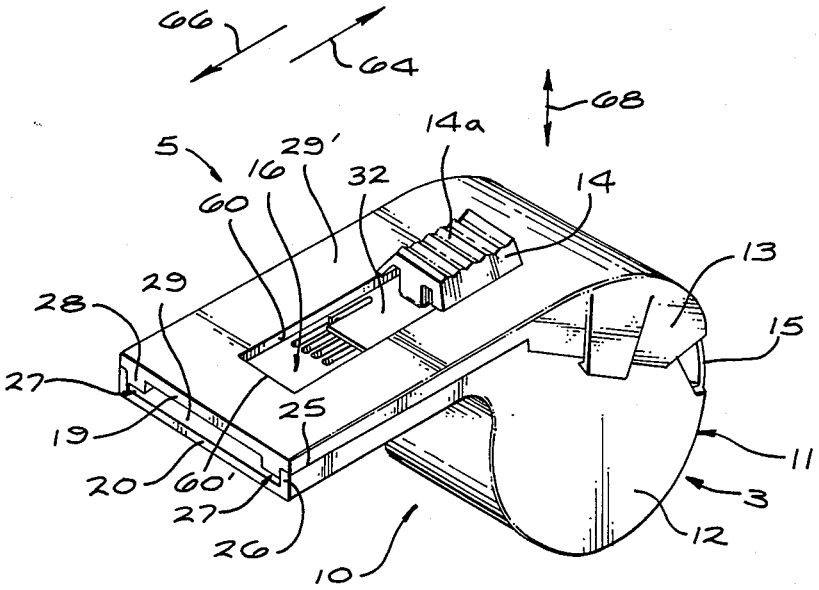
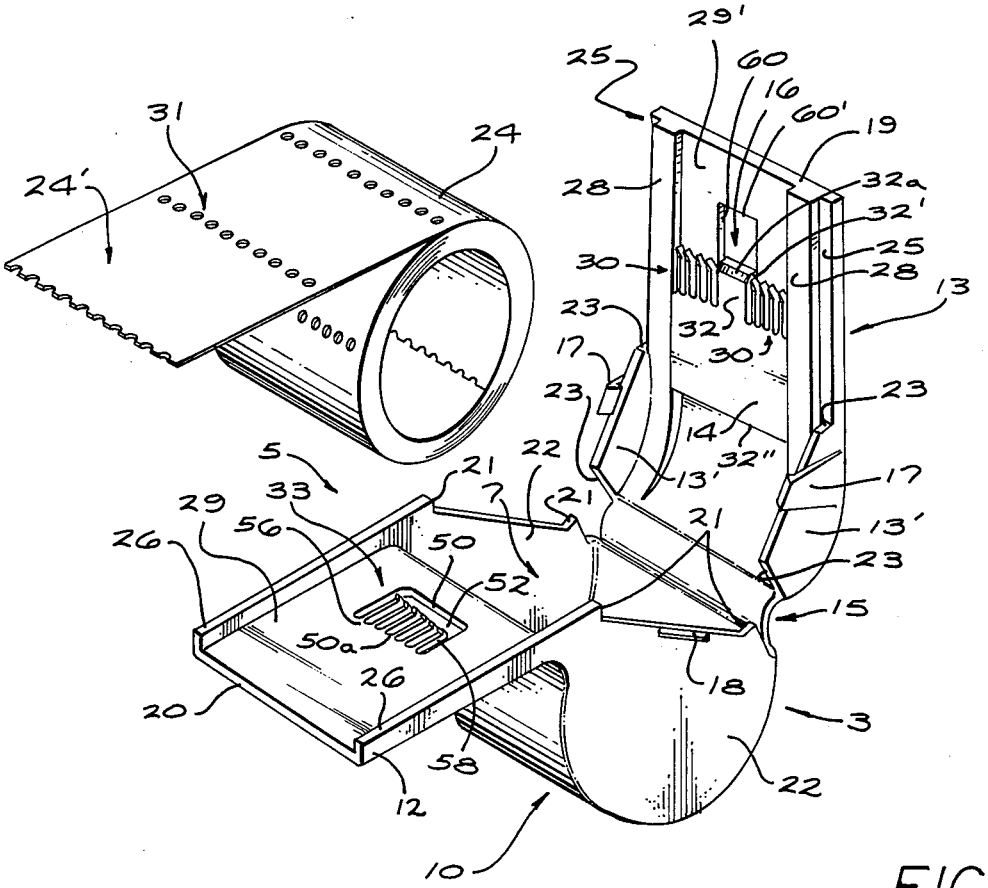
FIG. 2

FIG. 3
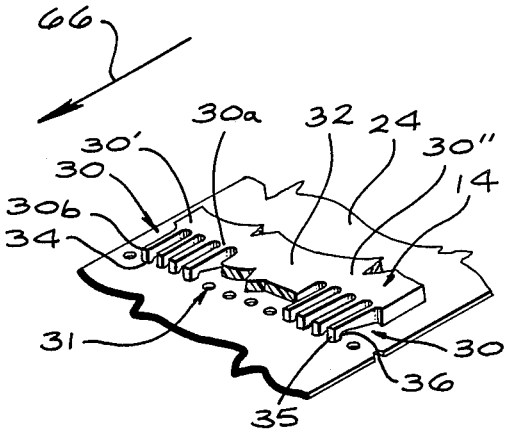
FIG. 4
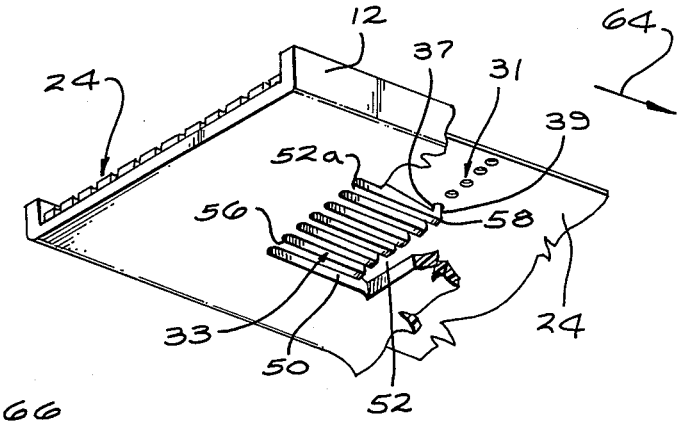
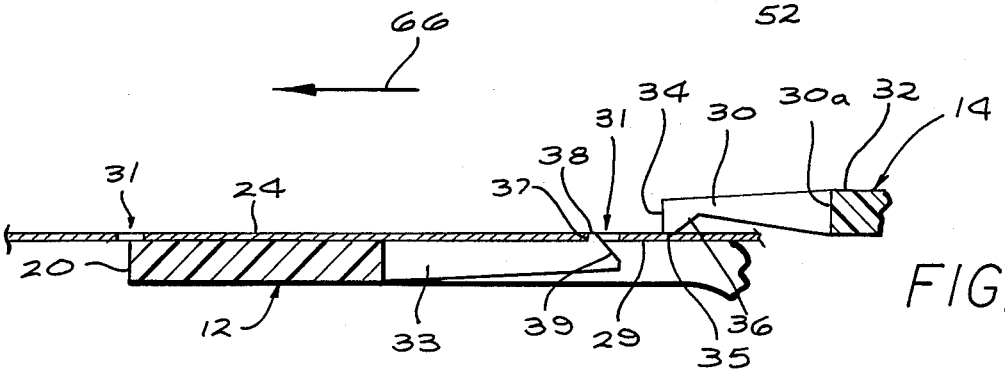
FIG. 5
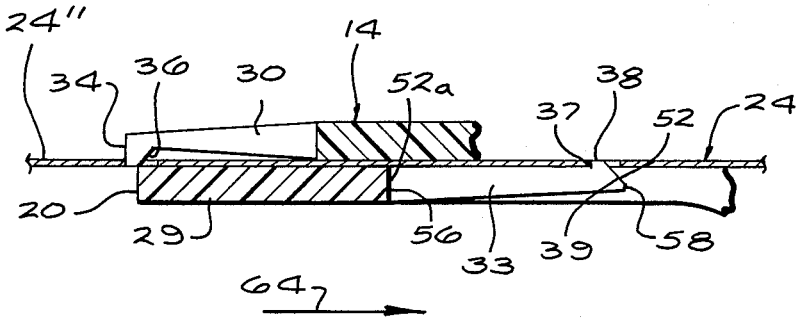
FIG. 6

ROLL STAMP DISPENSER

REFERENCE TO RELATED APPLICATION

This application is a continuation of our U.S. patent application Ser. No. 512,389, filed July 11, 1983, now abandoned.

BACKGROUND OF THE INVENTION

1. Field of the Invention

This invention relates to a dispensing device and more particularly to a device for permitting dispensing of a single item from a roll of perforated items.

2. Description of the Prior Art

In many applications it is desired to dispense a single item from a roll of items wherein each item in the roll of items is separated from the next item by a row of perforations. Rolls of postage stamps are an examplar of such items and the present invention is directed to an economical improved method for allowing dispensing of a single stamp from a roll of such perforated stamps. It will be appreciated that, for convenience, all such items, regardless of their use, are herein referred to generally as "stamps" and as "roll of stamps" and the invention herein is useful for dispensing all such items.

One type of dispenser for such stamps as heretofor utilized in dispensing. postage stamps provided for a storage of a roll of stamps in a container and manual pressure by frictional engagement of a finger or thumb with the actual stamps as utilized to advance the stamps and unroll the stamps to allow severing of a single stamp when it has moved a particular distance such as to the end of the dispenser. Problems with such a dispenser have often occurred due to the increased friction between the underside of the stamp and the dispenser being greater than the frictional engagement of the thumb or finger with the upper (or printed) side of the stamp resulting in slipping and also "cocking" of the stamp into the dispenser so that the stamp is at an angle to the dispenser and thus cannot be moved outwardly without adjustment. Such misoperation requires opening of the dispenser and realigning the stamp into the correct path. Further, such a dispenser requires visual accurate control of both the distance advanced and alignment of the perforations with the edge of the dispenser to allow manual severing of the single dispensed stamp from the remainder of the roll. It has been found that very often such distance control and/or alignment is not achieved and when attempting to severe the stamp instead of tearing on the perforation, the tear occurs in the stamp itself.

Other dispensing arrangements have utilized comparatively complex mechanisims for automatic dispensing of a single item from a perforated roll. Such mechanisims, of course, are associated with ticket dispensers as utilized, for example, at motion picture theatres, sporting events and the like. Such dispensers are often complex, expensive and non-portable devices. Further the cost thereof is comparatively high.

When consideration is given to the dispensing of postage stamps, it will be appreciated that because of the extremely large number of people utilizing postage stamps as contained on a roll, such dispenser for postage stamps should be very low cost in fabrication and also provide almost "automatic" operation so that actuation there of moves the stamp the required distance and positions the perforations accurately to allow proper severing.

Accordingly, there has long been the need for a stamp dispensing arrangement that may be economically fabricated, comparatively small and light in weight, that may have utilization for dispensing stamps from a roll of stamps.

SUMMARY OF THE INVENTION

Accordingly, it is an object of the present invention to provide an improved dispensing arrangement for dispensing a single stamp from a roll of stamps;

It is another object of the present invention to provide a manually operated dispensing arrangement for dispensing a single stamp from a roll of stamps.

It is another object of the present invention to provide a stamp dispensing arrangement for dispensing a single stamp from a roll of stamps in a sequential operation that is economical to fabricate, easy to utilize and has a minimum of moving parts associated therewith.

The above and other objects are achieved, according to a preferred embodiment of the present invention by providing a dispensing arrangement that has a total of two parts and only one moving part. A unitary, that is a single molded part, body is provided to hold the roll of stamps and a slide is movably mounted on the body so that acutation of the slide advances the stamps to the correct amount and positions the perforations in the proper location to allow severing. The body has a base and a cover hingedly interconnected for pivotal movement therebetween from a closed position to an open position. In the open position a roll of stamps may be placed in a stamp storage cavity of the body and in the closed position the roll of stamps is retained in the stamp storage cavity and the leading stamp at the free edge of the roll of stamps extends through a stamp dispensing portion of the body. The cover and the base have planer spaced apart substantially parallel walls approximately the width of the stamps to be dispensed and as the stamps are unrolled from the roll the stamps travel between the spaced apart planer walls of the cover and the base at the dispensing end thereof.

There is an aperture in the planer wall of the base and positioned within the aperture are a plurality of fingers extending into the aperture and having first stamp engaging tab means at remote ends thereof. The fingers are spaced apart the perforation spacing of the roll of stamps and extend through the perforations to prevent movement of the stamps in a first direction, which first direction corresponds to the rewinding or re-rolling of the stamps.

The slide is mounted in an aperture in the planer wall of the cover and is mounted for sliding movement in the first direction as above described and in a second direction opposite the first direction, and movement in the second direction may be termed the dispensing direction. The slide means has a knob extending through the aperture to regions external the body for manual operation of the slide for movement in the first and second directions. The slide also has a plurality of second fingers positioned intermediate the planer wall of the cover and the base in the closed position and the second fingers have second stamp engaging tab means at the remote ends thereof in a spaced apart relationship corresponding to the spacing of the perforations of the stamps. The second stamp engaging tabs on the second fingers engage the stamps in the perforation and as the slide is moved in the second direction the stamps are unrolled from the roll and progress through the dispensing portion of the body. The travel of the slide in the second direction corresponds to the spacing between the rows of perforations in the stamps so that a single stamp to be dispensed projects outwardly from the dispensing end edges of the planer walls of the cover and the base at the limit of travel of the slide in the second direction. The perforations in the stamp are aligned with the dispensing end edges and the stamp may be then manually severed from the remaining stamps in the roll. Movement of the slide back in the first direction to the limit of the travel thereof positions the second stamp engaging tab means in the next row of perforations.

BRIEF DESCRIPTION OF THE DRAWING

The above and other embodiments of the present invention are more fully disclosed in the following detailed description taken together with the accompanying drawings wherein similar reference characters refer to similar elements throughout and in which:

FIG. 1 is a perspective illustration of a preferred embodiment of the present invention in the closed position thereof;

FIG. 2 is a perspective illustration of the embodiment shown in FIG. 1 in the open position thereof with a roll of stamps to be inserted therein;

FIG. 3 is a partial perspective illustration of the slide means of the present invention engaging the stamps to be dispensed;

FIG. 4 is a partial perspective illustration of the present invention showing engagement of the roll of stamps to prevent movement thereof in a first direction;

FIG. 5 is a partial sectional view embodiment shown in FIG. 1 at the beginning of the dispensing operation thereof; and FIG. 6 is a partial sectional view of the embodiment shown in FIG. 1 at the end of the dispensing operation thereof.

DESCRIPTION OF THE PREFERRED EMBODIMENTS

Referring now to the drawing there is illustrated a preferred embodiment generally designated 10 of the present invention. As utilized herein the embodiment 10 of the present invention is described and illustrated for dispensing postage stamps from a roll of postage stamps. However, as noted above, such description is for purposes of illustration only and, of course, the present invention is not limited to a structural arrangement for dispensing only postage stamps from a roll of postage stamps. Rather, the present invention may be utilized for dispensing any type of items that are separated from each other by spaced apart rows of perforations and stored in a rolled configuration.

The embodiment 10 generally comprises a body 11 having a base 12 and a cover 13 hingedly interconnected by hinge 15 for pivotal movement therebetween. In FIG. 1 the body 11 is in the closed position which is the position thereof when stamps are dispensed therefrom. FIG. 2 illustrates the body 11 in the open position wherein the roll of stamps 24 is to be positioned therein.

The roll of stamps 24 may, as indicated above, may be a conventional roll of postage stamps in which the individual stamps are separated by substantially parallel rows of spaced apart perforations 31. The spacing between each perforation in any one row of perforations 31 is predetermined as is the spacing between adjacent rows 31 of perforations. The dispensing arrangement of the present invention utilizes the known spacing between rows of perforations and between the individual perforations in any one row in a manner a hereinafter set forth.

The cover 13 is detachably latched in the closed position to the base 12 by interaction of the snap detent levers 17 on the cover 13 with the projections 18 on the base 12 and, when so engaged, restrain the body 11 in the closed position, as illustrated in FIG. 1. When the levers 17 are disengaged, for example, by pressing the side walls of the body 11 towards each other so as to disengage the projections 18 from the detent lever 17, the cover 13 moves pivotally on the hinge 15 away from the base 12 to the open position as shown in FIG. 2.

In the preferred embodiment and of the present invention the entire body 11 including the base 12, cover 13 and hinge 15 are unitarily fabricated from a single, for example, molding of a semi-rigid plastic such as polyethelene or the like, nylon, or any other material suitable for the purpose and having a predetermined degree of flexibility associated therewith.

The roll of stamps 24 is positioned within the body 11 at the roll of stamps storage end portion 3 thereof and, when the roll of stamps 24 is positioned therein the free end of the roll of stamps 24 as indicated generally at 24' extends through the dispensing end portion generally designated 5 of the body 11. As clearly shown in FIGS. 1 and 2 the hinge 15 is formed at the roll of stamps storage end portion 3 of the body member 11. In the closed position of the body member 11, as illustrated in FIG. 1, the dispensing end edge 19 of the cover 13 is maintained substantially co-planer with the dispensing end edge 20 of the base 12 by engagement of the shoulders 21 on the body member 12 with edges 23 of the cover 13.

The storage end portion 3 of the body 11 has walls such as side walls 22 of the base 12 and walls 13' of the cover 13 which define a roll of stamps storage cavity, generally designated 7 into which the roll of stamps 24 is positioned with the free end 24' extending through the dispensing end 5 of the body 11. The base 12 has a planer wall 29 in the dispensing end regions thereof and the cover 13 has a planer wall 29' in the dispensing end regions thereof. The planer walls 29 and 29' are, in the closed position as illustrated in FIG. 1, in opposed, predetermined, spaced apart, substantially parallel relationship. Upstanding side walls 26 on planer wall 29 engage the surfaces 25 of planer wall 29' in the closed position as illustrated in FIG. 1 to maintain the substantially parallel predetermined, spaced apart relationship between the planer walls 29 and 29'.

The planer wall 29 has edges 50 defining an aperture 52 therethrough. A plurality of spaced apart first finger means generally designated 33 have first ends 56 at the edge **50*a* of edges 50 and remote ends 58 in the aperture 52. The remote ends 58 have first stamp engaging tab means at the remote ends 58 thereof which have a ramp surface 39 and a vertical surface 37 as shown most clearly in FIGS. 4–6. The first fingers 33 as illustrated, for example, in FIG. 6 have limited resilient movement towards and away from the planer wall 29' of the cover 13 in the closed position as illustrated in FIG. 1 in the directions as indicated by the arrow 68 in FIG. 1**.

The planer wall 29' of the cover 13 has projections 28 thereon which are spaced apart from the planer surface 29 of the body 12 when in the closed position as illustrated in FIG. 1. The spacing of the projections 28 from the surface 29 in the closed position is comparatively small and provides a small clearance between the wall 29 and projections 28 to allow the stamps from the roll of stamps 24 to pass therebetween. Such comparatively small clearance, it has been found, tends to prevent jamming of the stamps during the dispensing operation.

The spacing between the plurality of first fingers 33 is approximately equal to the spacing between individual perforations in a row of perforations 31 in the roll of stamps 24.

The planer wall 29' of cover 13 is provided with edges 60 defining aperture 16 therethrough and the aperture 16 is, for the body 11 in the closed position as illustrated in FIG. 1 in regions adjacent the aperture 52 defined by the edges 50 in the planer wall 29 of the base 12 and in opposed relationship thereto.

A manually operable unitary slide means 14 is slidably mounted on planer wall 29' in aperture 16 for sliding movement in a first or return direction indicated by arrow 64 and a second or dispensing direction as indicated by the arrow 66. The slide 14 has ramp means 32 positioned intermediate the walls 29 and 29' for the body 11 in the closed position as illustrated in FIG. 1. The slide means 14 has a plurality of spaced apart second finger means generally designated 30 and the spacing between the individual finger means 30 is substantially equal to the spacing between the perforations in the row of perforations 31 of the roll of stamps 24. As shown most clearly in FIG. 3 the preferred embodiment 10 of the present invention incorporates two groups 30' and 30'' of the second finger means 30 and the groups 30' and 30'' thereof are in spaced apart relationship such that the second fingers 30 are transversely spaced from the first fingers 54 of the planer wall 29 and free of engagement therewith during movement of the slide 14 in the directions indicated by the arrows 64 and 66.

In preferred embodiments of the present invention the slide 14 also is mounted on the planer wall 29' for limited movement in the directions indicated by the arrow 68, which is substantially perpendicular to the walls 29 and 29', for reasons hereinafter described.

First ends **30*a* of each of the second finger means 30 are at the ramp 32 and each of the second fingers 30 have remote ends 30*b* having second stamp engaging tab means 35 thereon. The tab 35 has leading edge surface 34 and a trailing edge surface 36 as shown most clearly in FIGS. 5 and 6**.

The ramp means 32 has a leading edge generally designated 32' having a ramp like surface designated **32*a*, and a trailing edge surface 32''. If desired, the trailing edge surface 32''** may also be ramp like.

The slide 14 also has a manually operable knob **14*a* extending in regions external the body 11 for manual operation to move the slide 14 in the directions indicated by arrows 64 through 66. The fingers 30 also have a limited degree of resiliency for limited resilient movement in the directions towards and away from the planer surface 29 of the base 12**.

In operation, the body to 11 is provided with a roll of stamps 24 by squeezing the side walls 22 of the base 12 together to release the detent 17 and provide the body 11 in the open position as illustrated in FIG. 2. The roll of stamps 24 is then placed in the cavity 7 with the free end 24' of the roll of stamps 24 extending between the planer wall 29 of the base 12 and the planer wall 29' of the cover 13. The slide 14 may be in, for example, the retracted position as illustrated in FIG. 1. Preferably, the free end 24' of the roll of stamps 24 is adjusted so that the surfaces 37 of the first stamp engaging tab means of the first finger means 33 extend through the perforations in a row of perforations 31 of the roll of stamps 24. The cover 13 is rotated on hinge 15 to the closed position as shown in FIG. 1 and the detents 17 engage the projections 18 to restrain the body member 11 in the closed position. The free end of the roll of stamps 24 extends along the planer wall 29 in base 12 and, at the edges, closely adjacent the projections 28.

FIGS. 3, 4, 5 and 6 generally illustrate the various positions of the structure of the present invention during the operation thereof. With the roll of stamps 24 inserted into the cavity 7 as above described and the body 11 in the closed position as illustrated in FIG. 1, the knob **14*a* of the slide 14 as engaged by, for example, the thumb, may be moved in the direction of the arrow 66. The second stamp engaging tab at the remote ends 30*b* of the second fingers 30, as illustrated in FIG. 3, enter the perforations of the row of perforations 31 in the roll of stamps 24 and, upon movement of the slide means 14 in the second direction indicated by the arrows 66 moves the free end 24' of the roll of stamps 24 therewith. During such movement the tips of the second stamp engaging tabs at the second end 30*b* of the second fingers 30 bear against the inner surface of the planer wall 29 of the base 12. The resilient nature of the material from which body 11 is formed allows such movement of the fingers 30**, without distortion thereof.

When dispensing action is first commenced from the position of the embodiment 10 shown in FIG. 1, as the slide 14 is moved in the direction of the arrow 66 with the stamp engaging tabs on the second fingers 30 engaging the row of perforations 31 in the roll of stamps 24, the ramp-like surface **32*a* of the ramp 32 engages the surface 39 of the first fingers 33 and depresses the first fingers 33 so that the tip of the first stamp engaging tabs thereon do not project above the upper surface of the roll of stamps 24. The resilient nature of the material from which the body 11** is fabricated allows such movement.

In the position illustrated in FIG. 1, the first fingers 33 engage the holes in a row of perforations 31 in the roll of stamps 40 and the surface 37 thereof prevents movement of the stamps in the roll of stamps 34 in the first direction indicated by the arrow 64 as shown in the view of FIG. 4.

As noted above the extent of travel of the slide 14 in the directions indicated by the arrows 64 and 66 is substantially equivalent to the spacing between adjacent rows of perforation 31. Thus, as shown in FIGS. 5 and 6 as the slide 14 is moved in the direction of the arrow 66 the surface 34 of second fingers 30 engages the row of perforations in which the first stamp engaging tab means of first fingers 35 are positioned. The stamps 34 are then moved by the slide 14 one stamp width or the separation between the rows of perforations 31 for the complete extent of travel of the slide 14 from the position shown in FIGS. 1 and 5 to the position shown in FIG. 6. The surface 28, on interior edges thereof, may aid in guiding the slide 14 during movement.

The resilient nature of the material from which the body 11 is fabricated allows the second stamp engaging tab means of the second fingers 30 to not only extend beyond the dispensing edge 20 of the base 12 but also slightly overlie the edge 20 of the base 12 as shown in FIG. 6. It has been found that this is advantageous since, when the stamp as indicated at 24'' is to be severed, the overhanging, interfering arrangement of the second tabs of the second fingers 30 with respect to the dispensing edge 20 of the planer wall 29 of the base 12 insures a clean severance of the single stamp 24" along the perforations 31 without pulling additional stamps from the roll outwardly during the tearing motion. Further, it has also been found that the actuation and operation as above described also prevents tearing of the stamps in places other than along the perforations 31.

When it is desired to dispense another stamp, the slide 14 is moved in the first direction indicated by the arrow 64 from the position shown in FIG. 6 back to the position shown in FIG. 5. During such movement the resilient nature of the second fingers 30 as the surface 36 engages the stamp at the perforations 31 allows the fingers 30 to ride up so the tip of the second stamp engaging tab means slides on the upper surface of the stamps during the movement in the direction indicated by the arrow 64.

When movement is first begun from the position as indicated in FIG. 5, the surface 34 of the second stamp engaging tab means engage the perforations 31 in which the first stamp engaging tab means of the first fingers 33 are positioned. The ramp-like surface 39 of the first fingers 33 allows the stamps to be forced over the first stamp engaging tab means on first fingers 33 as the ramp-like surface 32*a* presses the first stamp engaging tab means on the first fingers 33 away from the surface 29'. The slight movement allowed in the mounting of the slide 14 in the directions indicated by the arrow 68 aid in this operation.

When the slide 14 is moved in the direction of the arrow 64 and movement of the roll of stamps 24 is stopped by engagement with the surface 37 of the first fingers 33, the second end 32" of the ramp 32 engages the surface 37 and rides thereover. Such engagement as the length of the ramp 32 rides over the tabs on the first fingers 54 during motion of the slide 14 in the first direction indicated by the arrow 64 does not disengage the first stamp engaging tab means on the first fingers 33 from the perforations 31 in the roll of stamps 24 therefor no movement of the stamps 24 in a first direction indicated by the arrow 64 occurs.

Thus, with reciprocating motion of the slide means 14, the stamps from the roll of stamps 24 are dispensed one at a time due to the extent of the dispensing movement of the slide means 14 being equivalent to the spacing between adjacent rows of perforations 31. When a stamp is moved into the position to be removed, it is torn off at the edge 20 of the planer wall 29 of the base 12 and, due to the over hanging thereof by the second stamp engaging tabs on the second fingers 30 the stamps are severed along the perforations 31. As above described, the resilient movement of the various components allows the motion of the stamps in the second direction for dispensing as indicated by the arrow 66 and prevents movement of the stamps in the first direction indicated by the arrow 64 during the return stroke of the slide 14.

It will be appreciated that, of course, the first fingers 33 may be split into two groups in transverse spaced apart relationship and the second fingers 30 in one group moving intermediate the two groups at first fingers 33. The ramp 32, in such an embodiment, has portions for engaging each of the groups at first fingers 33.

It will be appreciated that many modifications and adaptions of the present invention may be made by those skilled in the art and the appended claims are intended to cover all such variations and adaptations following within the true scope and spirit thereof.

We claim:

1. A dispensing arrangement for dispensing stamps from a roll of perforated stamps comprising, in combination:

a unitary body means having a base, a cover and a hinge joining said base to said cover for allowing relative pivotal movement therebetween from an open position permitting the roll of stamps to be inserted therein to a closed position permitting stamps to be dispensed therefrom, and each of said base and said cover having:

a roll of stamps storage end portion; and a dispensing end portion; and said hinge mounted on said storage end portions of said base and said cover;

said storage end portions of said base and said cover having:

walls defining a cavity for containing the roll of stamps in said closed position;

said dispensing end portions of said base and said cover having:

planer walls in opposed, predetermined spaced apart substantially parallel relationship in said closed position; and said planer walls of said base and said cover having dispensing end edges in a substantially aligned relationship in said closed position;

said planer wall in said dispensing end of said base having:

first edges defining an aperture therethrough; a plurality of spaced apart first finger means unitary with said planer wall of said base and said finger means having first ends at a first edge of said aperture in said base means, and second ends spaced therefrom and projecting into said aperture thereof, and said first finger means having limited resilient movement towards and away from said planer wall of said cover; and each of said plurality of spaced apart first finger means having:

first stamp engaging tab means for projecting into the space between said planer wall of said cover and said planer wall of said base in the closed position for entering the perforations of the roll of stamps to prevent movement of the stamps in the roll of stamps in a first direction and allow movement of the stamps in the roll of stamps in a second direction opposite said first direction;

said planer wall in said dispensing end of said cover means having:

second edges defining an aperture therethrough in regions aligned with said aperture in said base;

manually operable unitary slide means slidably mounted on said planer wall of said cover in said aperture therein for sliding movement in said first and second directions thereon and having an inner portion intermediate said planer walls of said base and said cover in the closed position, said inner portion of said slide means having:

a plurality of spaced apart second finger means each having an attachment end and a remote end, resiliently moveable for limited resilient movement towards and away from said planer wall of said base and free of engagement with said plurality of first finger means for movement of said slide means in said first and second directions;

each of said second finger means having:

second stamp engaging tab means on said remote end thereof for engaging the stamps in the perforations thereof to move the stamps in said second direction for movement of said slide means in said second direction, and said second stamp engaging tab means extending beyond said dispensing end edge of said planer wall of said base in a stamp dispensing position of said slide means and said second stamp engaging tab means overhanging said dispensing end edge of said planer wall of said base means a predetermined distance in said stamp dispensing position;

unitary knob means extending through said aperture in said planer wall of said cover for manual operation of said slide means in said first and second directions; and ramp means having a leading edge comprising a ramp surface for engaging said first tabs on said first finger means to depress said first tabs a predetermined distance for movement of said slide in said second direction.

2. The arrangement defined in claim 1 and further comprising:

latch means for detachably securing said cover to said base in said closed position.

3. The arrangement defined in claim 1 and further comprising:

rail means on said planer wall of said cover and extending a preselected distance towards said planer wall of said base for guiding said slide in movement in said first and second direction; and side edges on said planer wall of said base extending toward said planer wall of said cover for maintaining said spaced apart relationship therebetween in said closed position.

4. The arrangement defined in claim 1 wherein:

said leading edge of said ramp means is tapered and substantially aligned with said tab means of said second plurality of finger means.

5. The arrangement defined in claim 4 wherein:

said plurality of first finger means and said plurality of second finger means are spaced apart substantially the perforation spacing of the roll of stamps.

6. The arrangement defined in claim 5 wherein:

said plurality of second finger means further comprises:

a pair of groups thereof in spaced apart relationship, and said ramp means intermediate said pair of groups of said second finger means.

7. The arrangement defined in claim 6 and further comprising:

latch means for detachably securing said cover to said base in said closed position; rail means on said planer wall of said cover and extending a preselected distance towards said planer wall of said base for guiding said slide in movement in said first and second direction; and side edges on said planer wall of said base extending toward said planer wall of said cover for maintaining said spaced apart relationship therebetween in said closed position.

8. The arrangement defined in claim 7 wherein:

said slide means is mounted on said cover for limited movement toward and away from said planer wall of said base in said closed position.

9. The arrangement defined in claim 8 wherein:

said stamp engaging tab means on said plurality of first finger means have forward edges for resisting movement of the stamps in the first direction and trailing edges comprising a tapered ramp surface for permitting movement of the stamps thereover in the second direction.

10. The arrangement defined in claim 9 wherein:

said slide means further comprises a trailing edge spaced from said leading edge for engaging said forward edge of said plurality of first tab means on said first finger means and sliding thereover for movement of said slide in said second direction.

* * * * *